US005953840A

United States Patent [19]

Simson et al.

[11] Patent Number: 5,953,840

[45] Date of Patent: Sep. 21, 1999

[54] BANNER DISPLAY DEVICE

[76] Inventors: Anton K. Simson, 13227 Aubrey St.; Peter C. Brusso, 14530 Espola Rd., Suite A, both of Poway, Calif. 92064

[21] Appl. No.: 08/863,166

[22] Filed: May 27, 1997

Related U.S. Application Data

[63] Continuation-in-part of application No. 08/605,974, Feb. 23, 1996, Pat. No. 5,717,424, which is a continuation-in-part of application No. 08/195,394, Feb. 14, 1994, Pat. No. 5,493,802, which is a continuation-in-part of application No. 08/067,738, May 26, 1993, Pat. No. 5,410,330.

[51] Int. Cl.[6] ..... G09F 11/08

[52] U.S. Cl. ..... 40/471; 40/518

[58] Field of Search ..... 40/471, 518; 242/538, 242/538.1

[56] References Cited

U.S. PATENT DOCUMENTS

| | | | |
|---|---|---|---|
| 1,086,581 | 2/1914 | Billerman | 40/471 X |
| 4,162,585 | 7/1979 | Decaux | 40/471 X |
| 5,016,371 | 5/1991 | Aiken | 40/471 X |
| 5,392,549 | 2/1995 | Castro | 40/518 |
| 5,410,830 | 5/1995 | Aiken, Sr. | 40/518 |
| 5,598,651 | 2/1997 | Aiken et al. | 40/518 |
| 5,687,498 | 11/1997 | Keyser et al. | 40/518 |

*Primary Examiner*—Joanne Silbermann
*Attorney, Agent, or Firm*—Henri J.A. Charmasson; John D. Buchaca

[57] ABSTRACT

In a banner display device where a plurality of banners are mounted end-to-end upon a carrier web to form a scroll which is wound on a pair of parallel and spaced-apart rollers, means carried on the scroll for stretching or decompressing a medial section of a displayed banner sufficiently to eliminate wrinkles and small distortions. One embodiment uses means for propelling the medial section away from the web comprising resiliently flexible banner end sections or resiliently flexible strips framing the banner which, when partially wound over the rollers, resiliently assume a more planar tangential position in relation to the rollers, thereby allowing the medial section to jut anteriorly away from the carrier.

An embodiment further comprises two independent lateral support members capable of being mounted within enclosures having widely different widths. Components such as motors, transmissions, roller mounting spindles, control sensors and circuitry are mounted directly on the support members.

Command and control of the motors is accomplished through a programmed microprocessor which monitors the status of user manipulable switches and indicators. According to the microprocessor's software/firmware programming, pulse code modulated drive voltages are produced to accurately turn the motors at the proper speeds.

8 Claims, 12 Drawing Sheets

BANNER DISPLAY DEVICE

PRIOR APPLICATION

This is a continuation-in-part application of application Ser. No. 08/605,974 filed Feb. 23, 1996 now U.S. Pat. No. 5,717,424 which was a continuation-in-part of 08/195,394 filed Feb. 14, 1994 now U.S. Pat. No. 5,493,802 which was a continuation-in-part of 08/067,738 filed May 26, 1993 now U.S. Pat. No. 5,410,330.

FIELD OF THE INVENTION

This invention relates to scrolling banner display devices, and more particularly, to banner flattening mechanisms, roller command and control, and devices allowing replaceable banners and flexibility of banner dimensions.

BACKGROUND OF THE INVENTION

Scrolling charts that are alternately wound back and forth between a pair of rollers are commonly used on chart recorders, advertising displays and other devices where information must be continuously or intermittently displayed. Typically, in the advertising display field for example, the scrolling chart comprises a plurality of banners. Each banner is a distinct image which is displayed by the device for a time until the next banner is to be displayed.

Previous display devices suffer from three distinct problems:

1) They do not provide for simple, fast and inexpensive removal, replacement, or otherwise not showing one or more of the individual banners in a scrolling chart without increasing wrinkling or causing other visual impairments;
2) One device will not be configurable to custom sized, user produced banners without being prohibitively expensive; and,
3) The command and control circuitry is expensive, awkward and of limited configurability with respect to individual banner display times and relative motor tensioning due to differently sized charts.

As for the first problem, in the past, charts have been formed by preprinting the banners end-to-end on a long continuous sheet. The problem with this approach is that no single banner can be easily removed, replaced or skipped when a particular advertiser wishes to cease displaying that banner.

Changing a single banner was a labor intensive, time consuming process requiring removal of the rollers from the display device, cutting out the offending banner, splicing in the new banner, and reinstalling the rollers. Splicing fixtures were developed allowing replacement while the rollers remained installed; however, replacement was still time consuming. It required significant care and skill to ensure proper banner positioning, alignment and proper placement of any control markings which inform the scrolling device where a banner begins and ends.

One solution to the interchangeability problem involved attaching individual banners together end-to-end to form a long continuous sheet. Here, durability and proper alignment became the overriding problem. A high degree of skill and time were still required to make an adequate interchange. Displays using this approach tended to be expensive, more complicated and less reliable because the means for attaching the banners to each other had to be rugged and precise to maintain proper alignment.

Another solution involved using pockets or other containment envelopes permanently formed on a web style carrier into which banners are inserted. From a mechanical standpoint, pockets formed from multiple layers of material attached together are generally incapable of being rolled onto a roller without creating large wrinkles or lumps in the multiple layers which, in turn, causes alignment problems. This is due to the difference in circumference of the various layers as they are wound onto a roller and the fact that the layers are attached to each other at the endpoints. Inserting a banner inside a pocket adds a third layer between the pocket layers which further compounds the problem by increasing the radial difference between the wound layers, further encouraging lumps and wrinkles.

Using resilient materials such as soft vinyl fabric to form the pockets does allow outer layers to stretch and inner layers to compress. However, as the material stretches longitudinally, its width tends to contract, like a rubber band. Similarly, as it is compressed, the width will expand. The net effect is that bulges and wrinkles are still formed.

In general, the use of larger diameter rollers will proportionally reduce the problem, but the problem still exists. Similarly, using dissimilar materials for the front and back layers of the pocket offer only moderate improvement. For example, one may use relatively stiff plastic for the inner layer and soft vinyl for the outer layer. The resilient outer vinyl will stretch as it is wound and contract during display. This may work well in the short term, however, after being repeatedly wound and displayed, the vinyl will relax, creating a loose front surface that encourages lumps and wrinkles.

Therefore, the use of pockets will cause wrinkles or lumps when rolled up and/or wrinkles, lumps or otherwise unacceptable optics when displayed flat.

Another solution disclosed by Aiken in U.S. Pat. No. 5,174,055 involves attaching removable banners to a web style carrier. Again, differences in the winding circumference causes bumps or bulges during display. Although front and back transparent guide sheets placed across the viewing window tend to minimize the viewable bulges by forcing them to the trailing side of the window, they are not eliminated, and the displayed portion of the banner is still not planar while in view. Increased cost and the inconvenience of threading the web through the guide sheets during banner or scroll replacement limit the effectiveness of this solution.

Another solution disclosed by Mazzocco, Sr. in U.S. Pat. No. 3,510,973 involves attaching removable banners to permanent sliding attachment points mounted on a web style carrier allowing relative longitudinal displacement between banner and web (See Mazzocco Column 5, lines 3–26). One problem with this approach again involves wrinkling since the fastening strips or button-like tabs will not lie completely flat when wound onto a roller. Increased cost results since the button-like tabs must be made rugged enough to allow the repeated sliding and banner interchanges. In addition, the banners themselves must be made rugged so that the slots for the tabs do not wear through. In this field, ruggedization is synonymous with expense. Further, this approach causes scraping between the banner and web. Any dust or dirt caught between the layers will quickly cause scratches to the banner surface reducing its aesthetic appeal.

Accordingly, there is a need for an inexpensive device for adequately displaying, with a minimum of wrinkling, banners which may be simply and quickly interchanged, removed altogether or skipped.

As for the second problem, there is no industry standard size for banners. Often times, banner size varies according to many factors such as budget, the subject matter of the display, and its location in a particular venue. Previous devices such as disclosed by Singer (U.S. Pat. No. 3,726,031) provide a specific enclosure requiring specific banner sizes. Although both Shettleroe (U.S. Pat. No. 4,862,614) and Simson (U.S. Pat. No. 5,493,802) provide some flexibility in the vertical and horizontal dimensions respectively, it is somewhat limited. Displaying banners with dimensions falling outside the limited range of these devices incurs the cost of buying or building a new device of a different scale. Therefore, there is a need for a banner display apparatus having greater flexibility in banner size.

As stated above, the third problem involves the relatively expensive command and control circuitry provided in current scrolling display devices. Simson et al., U.S. Pat. No. 5,410,330 discloses circuitry designed specifically for controlling the variable motor speeds required during the display of a roller based scrolling chart display. However, this circuitry has limited configurability with respect to roller speeds and display times per banner. Also, in general, the cost of manufacturing a circuit board and soldering components generally increases with the number of components used. In addition, a circuit made up of numerous discretely manufactured electronic devices is usually less reliable than those circuits requiring less discrete devices. Also, increasing the amount of hardware increases power consumption, which in turn may increase the number and cost of discrete devices. Accordingly, there is a need for an inexpensive scroll display apparatus which uses a minimum of hardware while providing greater command and control flexibility.

SUMMARY OF THE INVENTION

The principal and secondary objects of this invention are to provide a banner display apparatus which:

1) Is capable of being configured to skip certain individual banners;
2) Allows individual banners to be removed or replaced without removing and re-installing the rollers or carrier;
3) Is capable of being configured to display custom sized banners mounted on charts and rollers of different lengths and widths;
4) Has reduced circuitry hardware and increased flexibility of command and control of the rollers; and
5) Minimizes the disadvantages described above such as banner lumps and wrinkles during display.

These and other objects are achieved by a banner display apparatus wherein a plurality of banners are mounted to a carrier web to form a scroll which is wound on a pair of parallel and spaced-apart rollers. Each banner comprises a medial section straddled by leading and trailing end sections which are attached to attachment points straddling each banner-holding portion of the web. During display, means carried on the scroll apply a longitudinal stretching force to the medial section sufficient to take up the slack generated through unwinding to remove wrinkles, lumps and other small distortions.

In one embodiment, sections of each banner proximate to the ends are made from resiliently flexible material. The width and resiliency of the end sections, and the distance between the attachment points is adjusted so that when a banner is displayed between the rollers, the point of attachment of the banner ends are wound onto the curved portion of each roller allowing the banner end sections free to assume, due to their resiliency, a more planar tangential position in relation to the rollers. This causes the longitudinal stretching taut of the medial section by propelling it outwards from the carrier web toward the front viewing window.

In another embodiment, strips of resiliently flexible materials are interposed between the banners and attached to the carrier at distances which provide for the proper spacing between attachment points. The width of the strips and their resiliency is adjusted so that when a banner is displayed, the strips framing that banner are wound onto curved portions of the rollers leaving marginal portions of the strips contiguous to the banners free to assume, due to their resiliency, a more planar tangential position in relation to the rollers, thereby propelling out the medial section and stretching it taut.

In yet another embodiment, suited to display orientations where roller axes are substantially parallel to the ground, and one roller is positioned above the other, the distance between the attachment points is adjusted so that during display the lower end section of the banner is allowed under the force of gravity to droop away from the lower roller, and thereby apply the stretching force sufficient to cause a planarization of the medial section of the banner.

The invention further comprises two independent lateral support members capable of being mounted within enclosures having widely different widths. Components such as motors, transmissions, roller mounting spindles, control sensors and circuitry are mounted directly on one of the support members.

Command and control of the motors is accomplished through a programmed microprocessor which monitors the status of user manipulable switches and the status of sensors which detect banner position, chart tension and user manipulable chart display indicators. According to the microprocessor's software/firmware programming, pulse code modulated drive voltages are produced to accurately turn the motors at the proper speeds.

DESCRIPTION OF THE PREFERRED EMBODIMENT OF THE INVENTION

Figure 1:
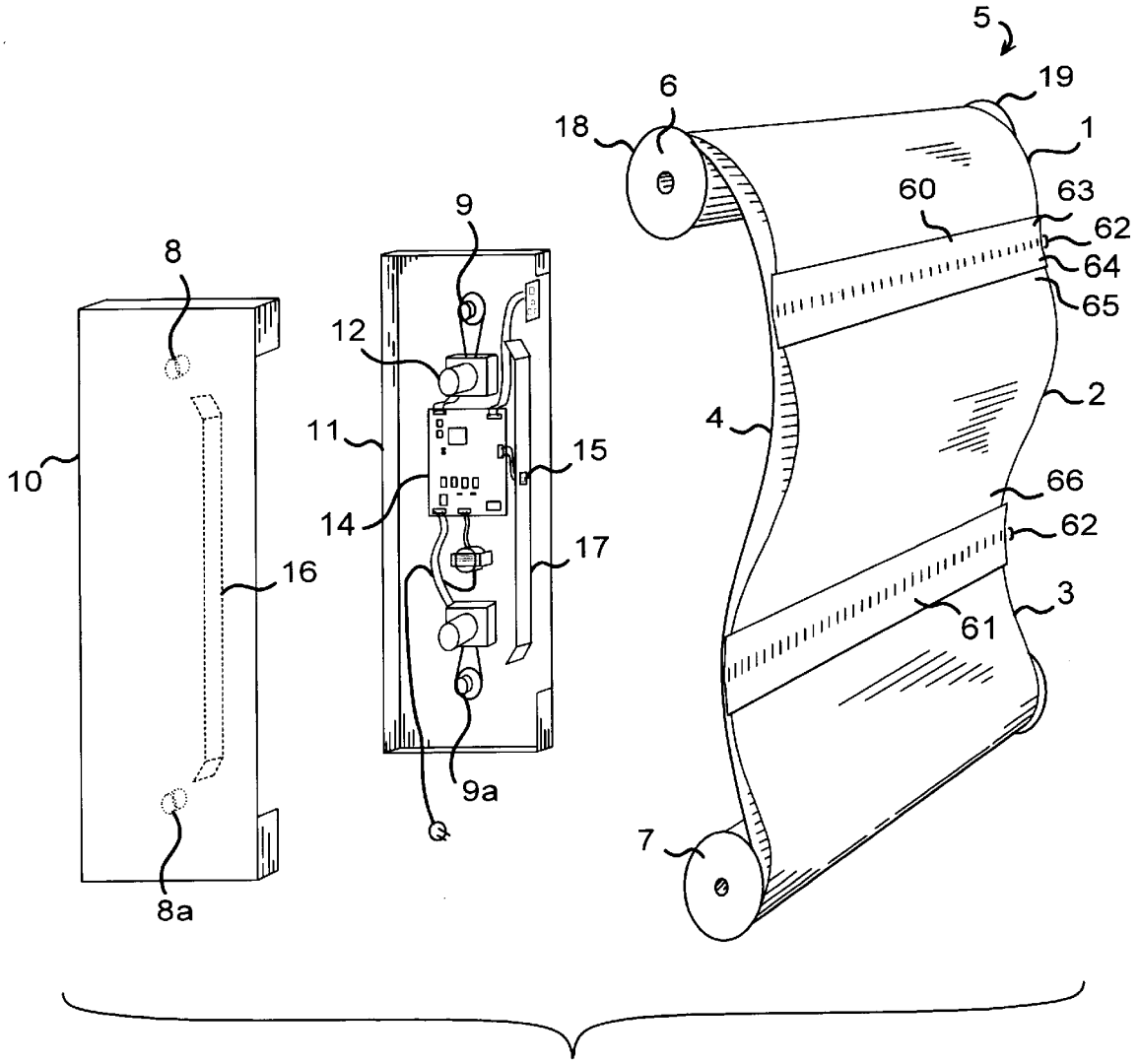
FIG. 1 is a perspective view of a banner display apparatus according to the invention.

Referring now to the drawing, there is shown in FIG. 1 a banner display apparatus where a plurality of pliable banners 1,2,3 are mounted upon the outer surface of a transparent web style carrier 4. The web/banner combination will be known collectively as a chart 5. The chart has opposite ends which are wound on a pair of substantially parallel and spaced-apart rollers 6,7.

Each roller can be rotatively mounted on a pair of spindles 8,9,8*a*,9*a* each extending inwardly from one of a pair of opposing lateral support members 10,11. One of the pair of spindles is a drive spindle 9 which is mechanically coupled through a transmission to a motor 12, the other spindle 8 is spring loaded to allow for quick installation and removal of the rollers.

The lateral support members 10,11 provide support for critical components of the apparatus such as the spindles, motors, transmissions and control circuitry 14 including a chart position sensor 15, logic and power supplies.

In addition, the lateral members provide edge guides 16,17 for maintaining the alignment of the traversing chart. Further alignment is provided by disk-shaped end plates 18,19 formed at the ends of each roller. In addition, the rollers need not be absolutely parallel. By slightly increasing the distance between the spring loaded spindles, the scroll is encouraged toward the opposite side during winding.

The advantage of having independent support members is that a single pair of members can be mounted within enclosures having a wide range of dimensions which display custom sized banners mounted on charts and rollers of different lengths and widths. The support members are mounted to the enclosure using screws or other means known in the art.

Figure 2:
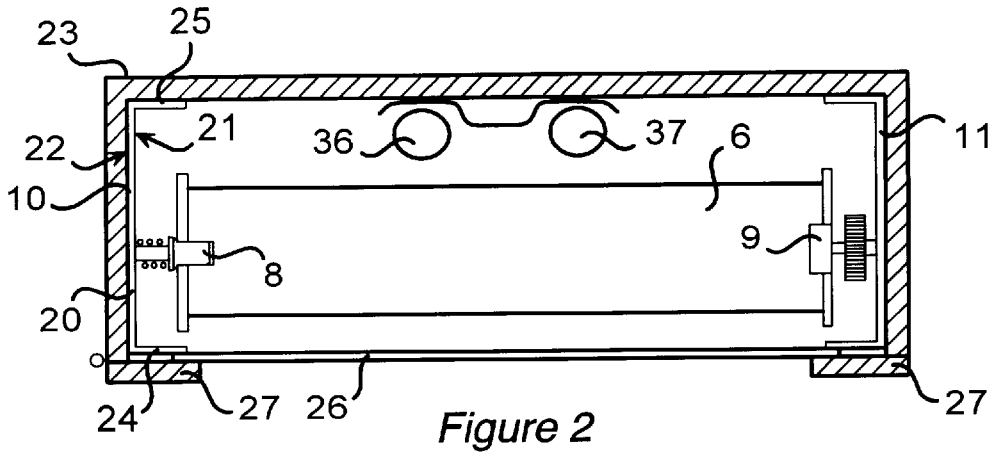
FIG. 2 is a cross-sectional diagrammatic top view of the apparatus of FIG. 1 as mounted within an enclosure.
Figure 3:
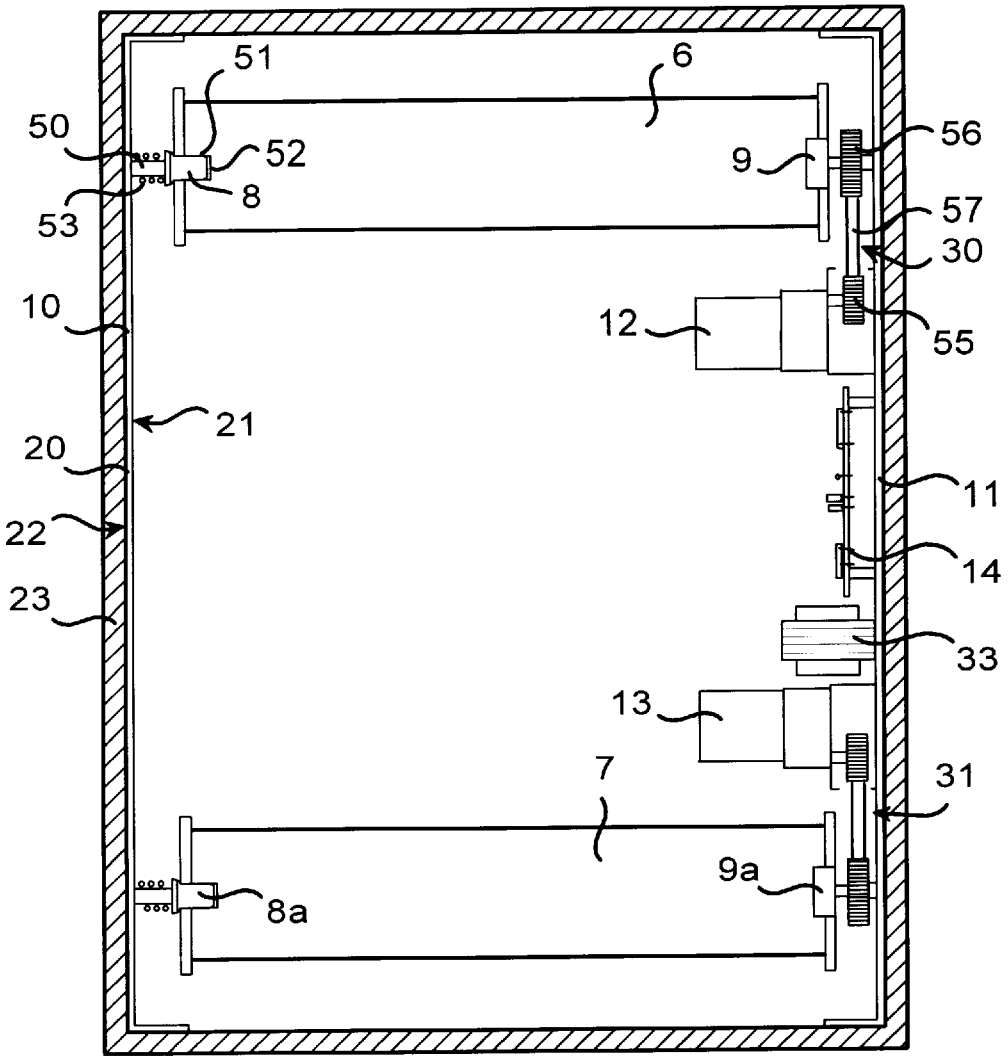
FIG. 3 is a cross-sectional diagrammatic front view of the apparatus of FIG. 1 as mounted within an enclosure.
Figure 4:
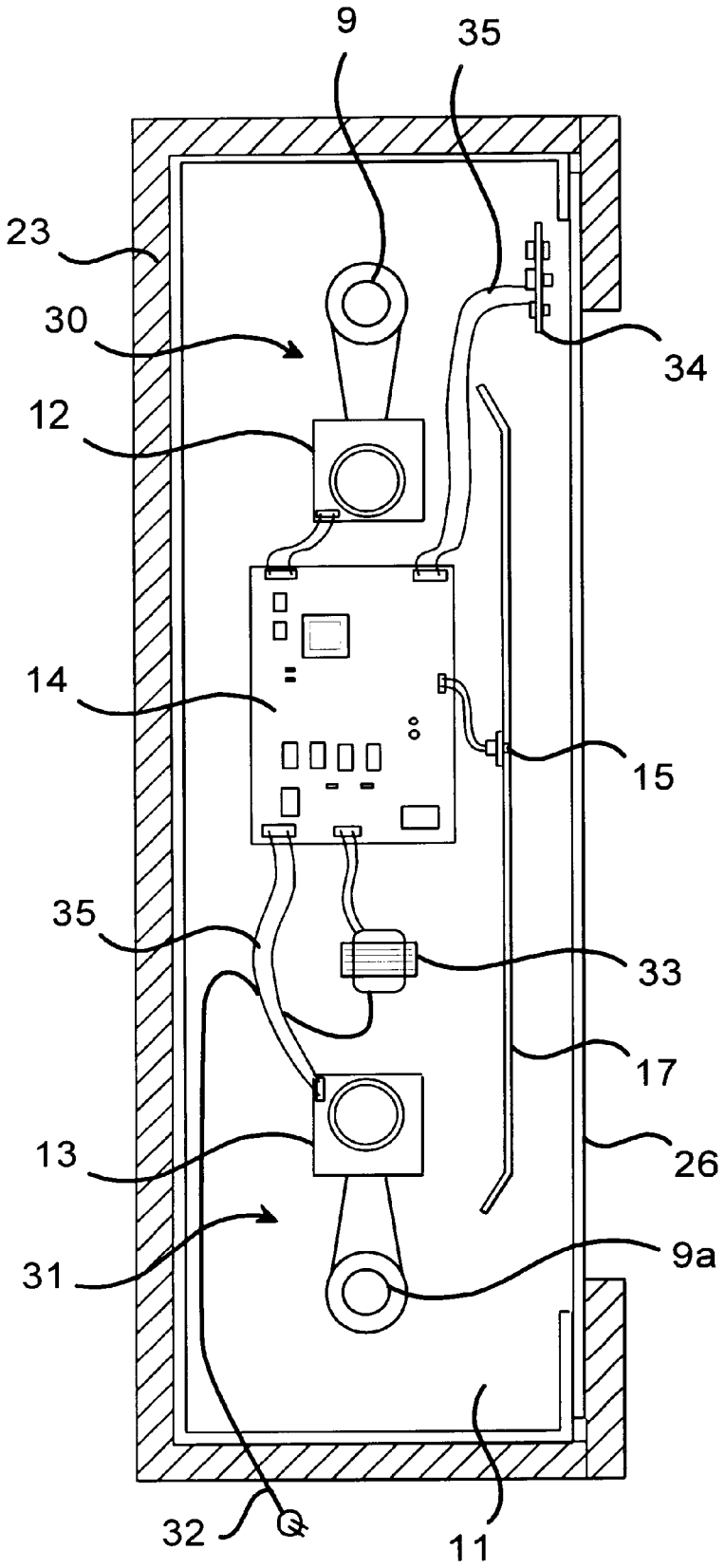
FIG. 4 is a cross-sectional side view of a support member of the apparatus of FIG. 1 upon which is mounted the major roller drive components.

Referring now to FIGS. 2, 3 and 4, the preferred mechanical features of the first and second lateral support members will now be described in detail. Each support member 10,11 comprises a base portion 20 having an inner surface 21 and a substantially planar outer surface 22 designed to rest flush against an inner wall of an enclosure 23. Front 24 and rear 25 flanges extend orthogonally from the base providing rigidity. In addition the rear flange provides a bearing surface for further securing the member to the enclosure. The front flange also provides a bearing surface for securing a transparent front viewing window 26 between the front flange and front door portions 27 of the enclosure.

Attached to the base of each support member is a chart guide flange 17 to prevent the displayed portion of the chart from frolicking into the rear areas of the apparatus. Each chart guide extends in a generally orthogonal manner from a region of the base which is located proximate to an edge of the traversing chart. The guides restrict movement of the chart to generally a plane behind and parallel to the plane of the viewing window. The front viewing window 26 itself provides a bearing surface for the displayed portion of the banner and further protects the chart and other internal mechanisms of the apparatus.

The base of the one support member 11 forms a secure platform for the attachment of other components of the apparatus including top and bottom motors 12,13, their transmissions 30,31, drive spindles 9,9*a*, power cable 32, transformer 33, control circuitry printed circuit board 14, manual operator input control panel 34, and various interconnecting wiring 35. The other support member 10 forms a platform for the attachment of the spring loaded spindles 8,8*a*. In the preferred embodiment, most of the components are mounted on only one of the support members to reduce wiring and allow for greater flexibility in the separation between the members.

An optical chart position sensor 15 is mounted preferably on the support member carrying the other circuitry. The sensor is positioned on the chart guide 17 at a point between the two rollers, to detect the passage of indicia or marks placed along the corresponding edge of each chart frame containing a banner. The detailed operation of the sensor and indicia features will be described later.

Referring to FIG. 2, fluorescent tubes 36,37 are mounted in the center of the rear of the enclosure to provide backlighting of the scrolling chart.

Figure 5:
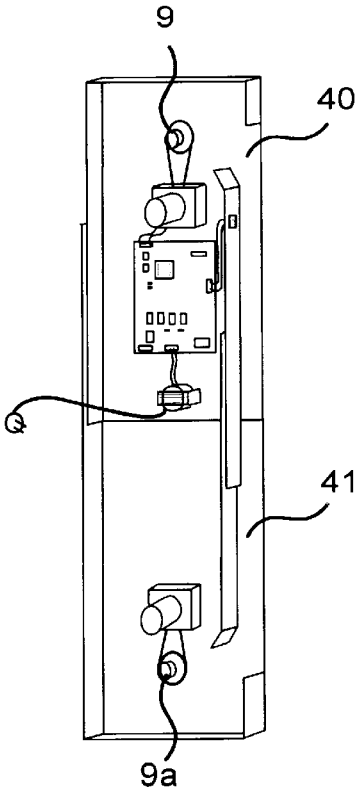
FIG. 5 is a perspective view of a telescoping support member according to the invention.

FIG. 5 shows that for added flexibility in spacing between the rollers, each lateral support member may comprise two interlocking and telescoping sub-members. An upper sub-member 40 slidingly engages a lower sub-member 41. This arrangement allows the distance between the drive spindle 9 of the upper sub-member and the drive spindle 9*a* of the lower sub-member to be varied according to banner dimensions.

Figure 6:
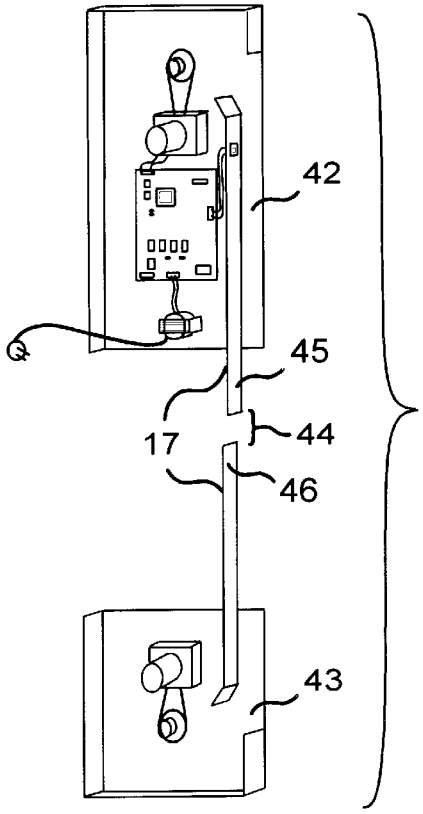
FIG. 6 is a perspective view of a separatable support member according to the invention.

FIG. 6 shows that in a less convenient embodiment the sub-members 42,43 may be completely separated to allow maximum flexibility in banner dimensions. It should be noted that the sub-members may be spaced apart such that a gap 44 forms between ends 45,46 of the disconnected chart guide flange 17. Small gaps will not adversely affect display operation. However, if wider gaps are anticipated, a strip of rigid material should be attached or otherwise interposed between the guide ends, thereby reducing or eliminating the gap with respect to the guide flange.

The preferred roller bearing and rotational drive mechanisms will now be described. The lateral support members provide means for rotatably mounting the rollers. As stated above, a drive spindle 9 is provided on a first member 11 to engage one end of a roller 6, and a spring-loaded spindle 8 is provided on the opposite member 10 to engage the opposite end of the roller.

The drive spindle 9 simply provides means for transmitting torque to the roller 6. This can be accomplished through any means known to the art such as a keyed spindle described in Simson, U.S. Pat. No. 5,493,802 incorporated herein by reference, or other approaches which provide adequate friction between the drive spindle and roller.

As shown in FIG. 3, each spring loaded spindle 8 has a central axle 50 and a freely rotating end cap 51 dimensioned to engage a central hole 52 in the end of a roller 6. The end cap is biased toward the roller by a spring 53 concentrically mounted around the axle. The ends of the rollers may be made symmetrical so as to engage either type of spindle.

Torque is transmitted from the motors to the drive spindles via transmission means. Although it would be possible to have the motor drive shaft act as the rotational axle for the drive spindle, this would generally require the relatively bulky motor to exist lateral to an end of the roller, or within the roller as described by Aiken, U.S. Pat. No. 5,174,055 which impacts on the ease of roller removal. In the preferred approach, referring to FIG. 3, a motor 12 directly drives a motor pulley 55, the rotation of which is transmitted to a roller drive pulley 56 through a belt 57. The roller drive pulley turns the axle of the drive spindle 9. In this way the bulk of the motor 12 can be located between the mounted rollers 6,7 and behind the exposed portion of the chart, thereby reducing the required width of the display apparatus. Further, the use of this type of belt and pulley assembly provides a damping mechanism between the motors and the rollers, reducing the transmission of noise and vibration. The belt and pulleys may be toothed to prevent slippage.

With reference to FIGS. 1, 7*a*, 7*b*, and 8–12 the preferred banner flattening mechanisms will now be described. In general, the banner flattening mechanism comprises means associated with each banner for longitudinally stretching taut a medial section of the banner being displayed. These means are carried on the scrolling chart itself rather than off the chart such as through the use of specialized guide rollers or other mechanisms. Although such guide rollers may be used without departing from the invention, it is a distinct advantage of the present invention to provide for banner flattening using the spooling rollers exclusively.

FIG. 1 shows a plurality of banners 1,2,3, each made of pliable, sheet material, mounted end-to-end to form a scroll. The scroll is carried upon a carrier web 4 of pliable, durable, substantially transparent material such as mylar. The scroll and web collectively form a chart 5 which is scrollable between two parallel, spaced apart rollers 6,7. The leading 65 and trailing 66 ends of a banner 2 are attached to the web 4 at attachment points 70,71 straddling a banner-holding portion 72.

Figure 7A:
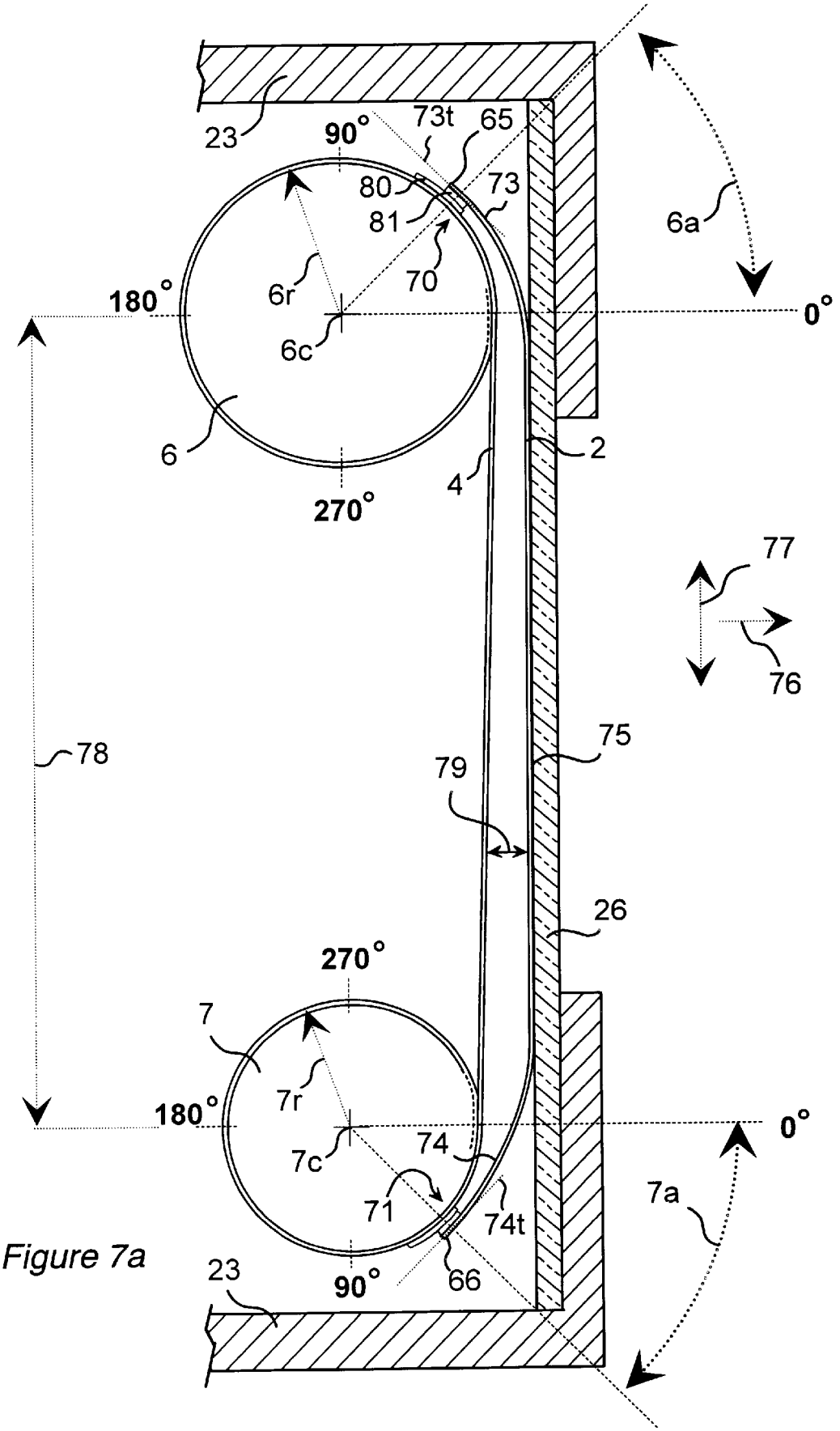
FIG. 7*a* is a cross-sectional diagrammatic side view of a chart wound upon two rollers showing the proper dimensions for implementing the banner flattening mechanism of the invention using the resiliently flexible banner end section feature.

Referring now to FIG. 7*a*, there is shown a first embodiment of the banner flattening mechanism. A scrolling chart is wound upon a pair of substantially parallel, spaced apart rollers 6,7 rotatively mounted within an enclosure 23. Locations on the outer curved surface of each roller can be expressed by a local polar coordinate system centered on its axis of rotation 6*c*,7*c*. Positive degrees are measured in the winding direction. Therefore, in the orientation of FIG. 7*a*, positive winding will be counter-clockwise with respect to the top roller 6, and clockwise with respect to the bottom roller 7. The size and relative distances between the components have been distorted for illustration.

In this embodiment, a banner 2 is shown in its display position, its ends 65,66 being attached to the web 4 at attachment points 70,71. Here, a hook-and-loop fabric style fastener such as a VELCRO Brand fastener comprising a loop pad 80 and a hook pad 81 are used to releasably attache the banner. Sections 73,74 of each banner proximate to the ends are made from resiliently flexible material. The distance between attachment points is adjusted so that when a banner is being displayed, the attachment points become positioned on a curved portion of each roller. This causes the end sections 73,74, due to their resiliency, to spring out to assume a more planar tangential position 73*t*,74*t* in relation to the rollers. This springing action propels the medial section 75 of the banner outwards from the carrier web toward the front viewing window 26. This effectively picks up the slack generated through unwinding, and stretches taut the medial section longitudinally 77. Wrinkles and other small distortions are reduced or eliminated so that the medial section attains a substantially planar orientation. Indeed, the entire displayed portion of the banner as seen through the front viewing window 26 has been stretched taut.

The portion of web 4 stretching between the rollers will typically remain taut in a plane tangent to both rollers with an amount of chart wound thereon. The medial section is therefore driven in the anterior direction 76 away from this plane.

In order for proper flattening during display, many factors must be taken into account including: 1) the dimensions of the display such as the radii of the rollers and the distance 78 between them; 2) the orientation of the display with respect to gravity; 3) the range of distances 79 in which the banner is expected to extend out from the web; and, 4) the physical properties of the banner such as its dimensions, density, overall mass and resiliency. However, it has been found that for most common applications using displays ranging in heights from about 20 cm (8 in.) to about 230 cm (90 in.) and using inherently resilient material such as mylar for the banners, optimum flattening occurs when the attachment points are positioned at a point which is at an angle of at least about 45 degrees 6*a*,7*a* on each roller. In this embodiment, angles beyond 90 degrees are less desirable. Clearly, angles close to or above 360 degrees are unacceptable due to the waste of material.

Note also that as the chart becomes fully wound onto one roller 6, its radius 6*r* is at a maximum while the radius 7*r* of the other roller 7 is at a minimum. The location of the attachment points, the resiliency of the end sections, and the minimum radius of the rollers may be adjusted to account for this phenomenon as well in obtaining proper flattening.

Although contact between the banner and the front viewing window 26 may further flatten the banner, it is not necessary. Indeed, such contact over time may cause unwanted abrasions to the banner. The resiliency of the end sections 73,74 may be adjusted to supply a sufficient stretching force so that the medial section 75 of the banner becomes taut without the aid of contact with the front viewing window. Or, other means may be employed such as starting the winding motor prior to the unwinding motor so that the banner is drawn away from contact with the front viewing window during transitions between banners.

Figure 7B:
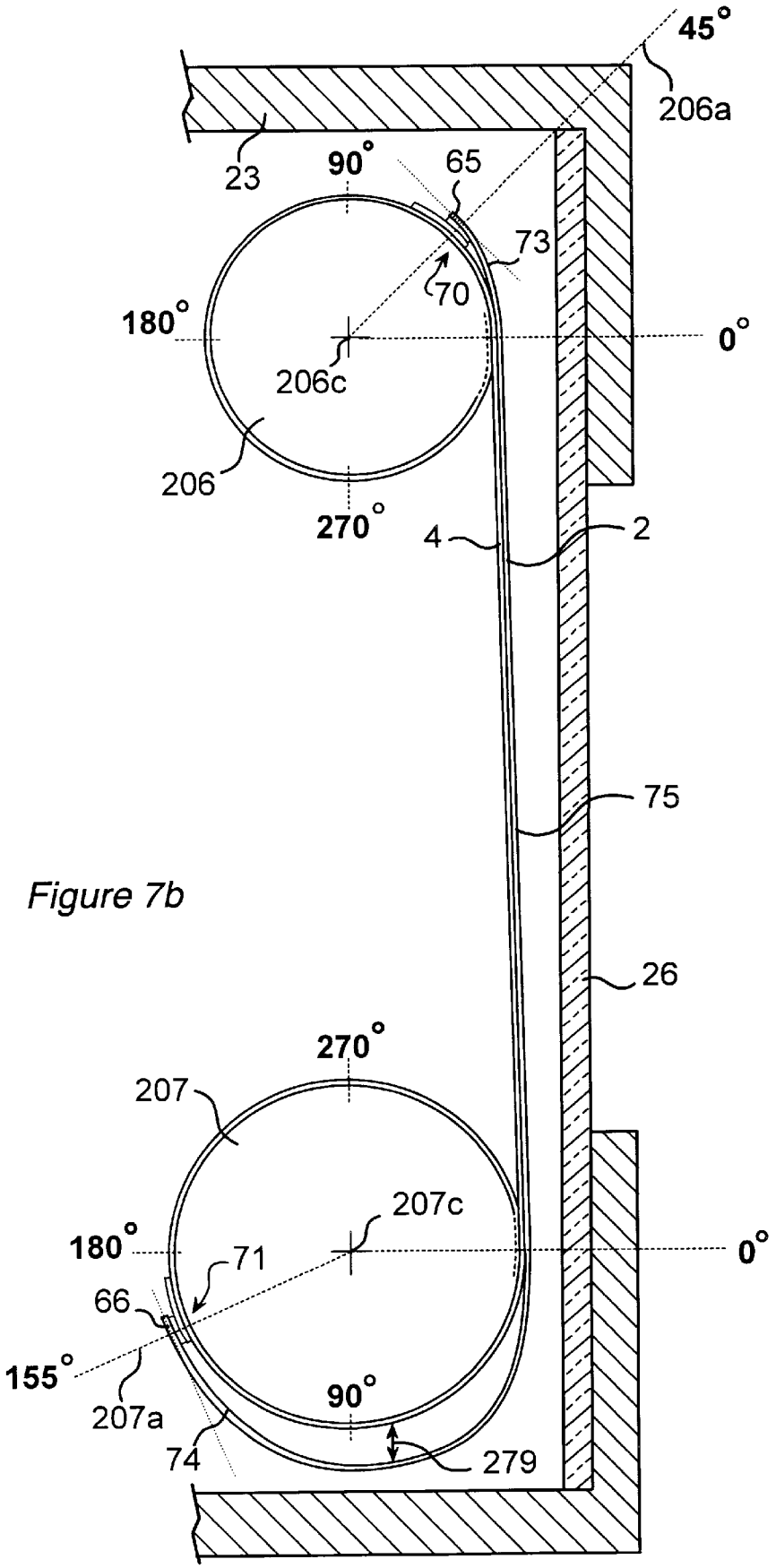
FIG. 7*b* is a cross-sectional diagrammatic side view of an alternate embodiment of the banner flattening mechanism using the gravity assisted, drooping banner end section feature of the invention.

Referring now to FIG. 7*b*, there is shown a second embodiment of the banner flattening mechanism. A scrolling chart is wound upon a pair of substantially parallel, spaced apart rollers 206,207 rotatively mounted within an enclosure 23. In this embodiment the roller axes 206*c*,207*c* are substantially parallel to the ground with one roller 206 being positioned above the other 207. As with the embodiment of FIG. 7*a*, locations on the outer curved surface of each roller are expressed by polar coordinate systems centered on each axis of rotation with positive degrees increasing in the winding direction of each roller.

A banner 2 is shown in its display position, having ends 65,66 attached to the web 4 at attachment points 70,71. The distance between attachment points is adjusted so that when a banner is being displayed, the attachment points become positioned on a curved portion of each roller.

Sections 73,74 of each banner proximate to the ends are made from flexible material. However, in this embodiment, these end sections need not be resilient. Instead, due to the force of gravity, the lower end section 74, is allowed to droop a distance 279 away from the lower roller 207, and thereby apply the stretching force sufficient to cause a planarization of the medial section 75 of the banner.

In this embodiment, the positioning of the lower attachment point 71 during display is therefore much more critical than the positioning of the upper attachment point 70. The lower attachment point must be sufficiently wound onto the lower roller 207 so that there is enough droop in the banner to sufficiently take up the excess in banner length over that of the web. This excess reaches a maximum toward the ends of the chart, when most of the chart is wound onto one roller. However, it has been found that for most common applications which use large diameter rollers relative to the amount and thickness of the chart, adequate flattening occurs when the lower attachment point is positioned at an angle of at least about 135 degrees 207*a*. The location of the upper attachment point 70 is less critical. However, angles between about 0 and 90 degrees 206*a* are preferred to reduce wasted material.

In this embodiment which uses non-resilient or weakly resilient end sections, the medial section 75 of the banner will at times remain in contact with the web 4, as shown in FIG. 7*b*, or at other times be propelled outward, depending on whether one roller has more of the chart wound upon it.

It should be appreciated that a combination of features from both the first and second embodiment will allow the medial portion to be propelled away from the web during display for all banners. For example, a resilient upper end section 73 from the first embodiment may be used in conjunction with a non-resilient lower end section 74 from the second embodiment.

When using a resilient lower end section, sections of the banner proximate to the lower end section may be propelled away from the web while still maintaining a taut medial section, depending on the positioning of the attachment point on the bottom roller and the length in the travel direction of the lower resilient end section.

FIG. 8 illustrates some of the preferred means for releasably bonding banners to the attachment points. FIG. 8*a* shows a portion of the carrier web 4 onto which has been placed an attachment point 70. One end 65 of a banner 2 is releasably attached to the attachment point by means of a hook-and-loop fabric style fastener such as a VELCRO Brand fasteners comprising a loop pad 80 mounted to the carrier web and a hook pad 81 mounted to the undersurface 82 of the banner along its end 65. The hook pad is preferably wide enough to extend over a range of allowed positions for the attachment point and to provide for the attachment point of an adjacent banner.

Figure 8A:
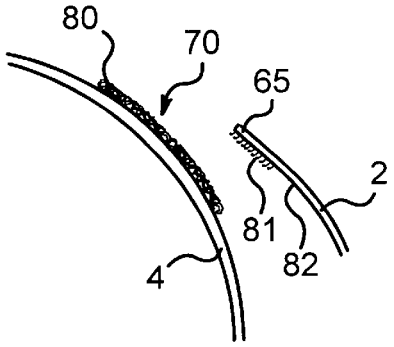
FIG. 8, *a–g* shows seven cross-sectional diagrammatic views of alternate embodiments for releasably bonding a banner to the carrier web according to the invention using the resilient banner end section feature.
Figure 8B:
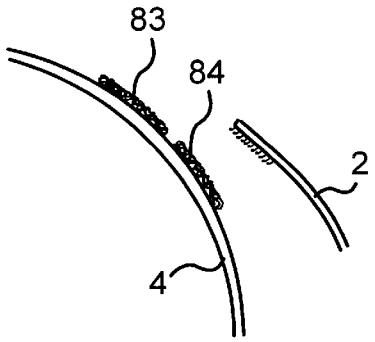

As shown in FIG. 8*b*, the hook pad may be split 83,84 to further signify the proper attachment point for each of two adjacent banners.

The use of a hook and loop style fastener is preferred over other attachment means because it is relatively inexpensive and because of the amount of play provided by the loop fibers. This allows for the automatic correction of minor attachment point alignment errors. It also acts more as a hinge than adhesive connectors, allowing the banner greater leeway in reaching an equilibrium between the resiliency of the banner end section and the strength of the attachment while the end section assumes a more planar tangential position in relation to the curved surface of the roller. Further, under this arrangement, the fastener is rebonded as it undergoes compression while the banner is fully wound onto one of the rollers.

Figure 8C:
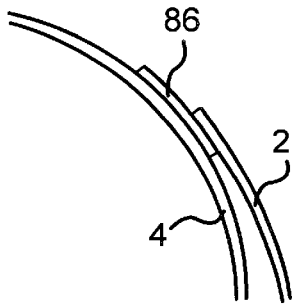

As shown in FIG. 8*c*, alternate means for attaching the ends of the banners to the web attachment points may be provided in the form of an adhesive layer 86 of material such as non-permanent glue, spirit gum or double-sided adhesive tape. In this case the layer is wide enough to provide attachment for two adjacent banner ends.

Figure 8D:
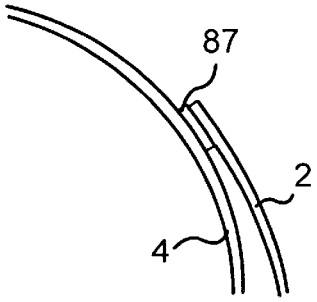

After repeated use the adhesive tends to lose its stickiness, requiring replacement. Therefore, as shown in FIG. 8*d*, individual banners may be provided with an adhesive layer 87 already positioned at each end for attachment to the web 4. The layer may be protected by a removable wax paper cover, insuring fresh adhesive with each new banner.

Figure 8E:
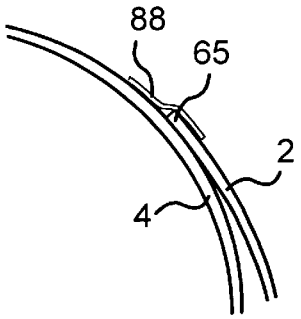

FIG. 8*e* shows that a piece of single-sided adhesive tape 88 may be used to join an end 65 of the banner 2 to the outer surface of the carrier web 4. The adhesive tape is placed on the outer surfaces of the banner and web. The advantages of this scheme are that the banner/web interface is protected by the tape layer, the attachment point has a very thin cross-sectional thickness, and tape is inexpensive. However, the tape layer is visible during scroll winding.

If stronger attachment is required, the attachment schemes of both 8*d* and 8*e* may be used for a single attachment.

Figure 8F:
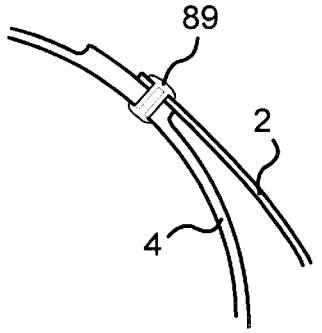

In FIG. 8*f* pop-through snap pins 89 may be used to join the banner 2 to the web 4. The pins may be independent, or permanently attached to the strip or banner or both. This scheme offers very strong attachment, requires very little skill during banner installation and prevents lateral migration of the banner. However, the pins and/or holes through which the pins project must be precisely positioned, increasing manufacturing costs, and the cross-sectional thickness of this connection is relatively large.

Figure 8G:
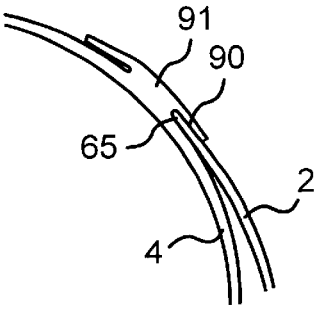
Figure 9:
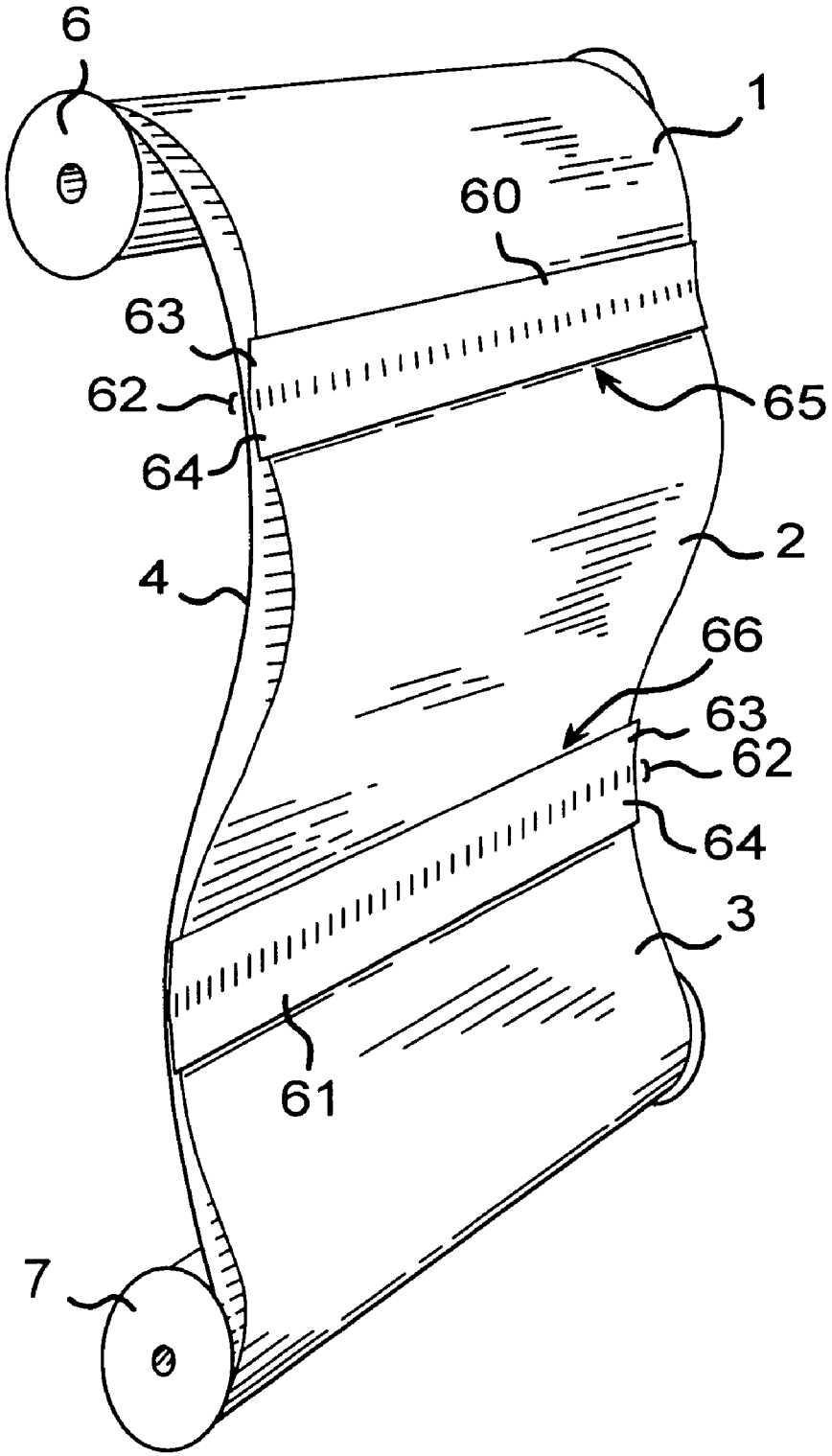
FIG. 9 is a diagrammatic perspective view of a roller mounted scroll using resiliently flexible strips to implement the banner propelling feature.

In FIG. 8*g* the end 65 of a banner 2 is inserted into a pinch pocket 90 formed between a resiliently flexible strip 91 and the carrier web 4. The end is held by a clamping force between the strip and the web. To improve attachment strength, adhesive or non-slip surfaces may be applied to the pocket and/or banner end surfaces. Care must be taken to provide adequate attachment strength since the pinching force may tend to weaken while the attachment point is wound onto a roller.

Proper mounting of the banners is achieved automatically when installing or loading a banner into a particular frame. First, the top end of a banner is attached to the carrier web at the upper attachment point. With its bottom end free, the banner is then wound smoothly onto the top roller. Finally, the banner's bottom end is attached to the web at the lower attachment point. It is apparent that this mounting method will work in either direction and for displays having vertical axis rollers.

Referring now to FIGS. 9–12, alternate means for propelling out a medial section of the banner are shown. As with the previous embodiment, these means are carried on the scrolling chart itself. In this embodiment, interposed between each pair of adjacent banners is a resiliently flexible strip 60,61 of laminar material such as mylar. The strips are preferably black or otherwise opaque to maintain an aesthetic separation between banners and to prevent viewing of the internal mechanisms through the web as the scroll is being wound. Each strip 60,61 has a medial portion 62 which is attached to the web 4. Further, each strip has marginal flaps 63,64 extending into banner-holding portions of the web. Portions of the flaps are secured to the leading 65 and trailing 66 edges of the banners.

Although the carrier is preferably a solid transparent sheet, it may be ladder-shaped having central cutouts conforming with the banner display area.

Figure 10:
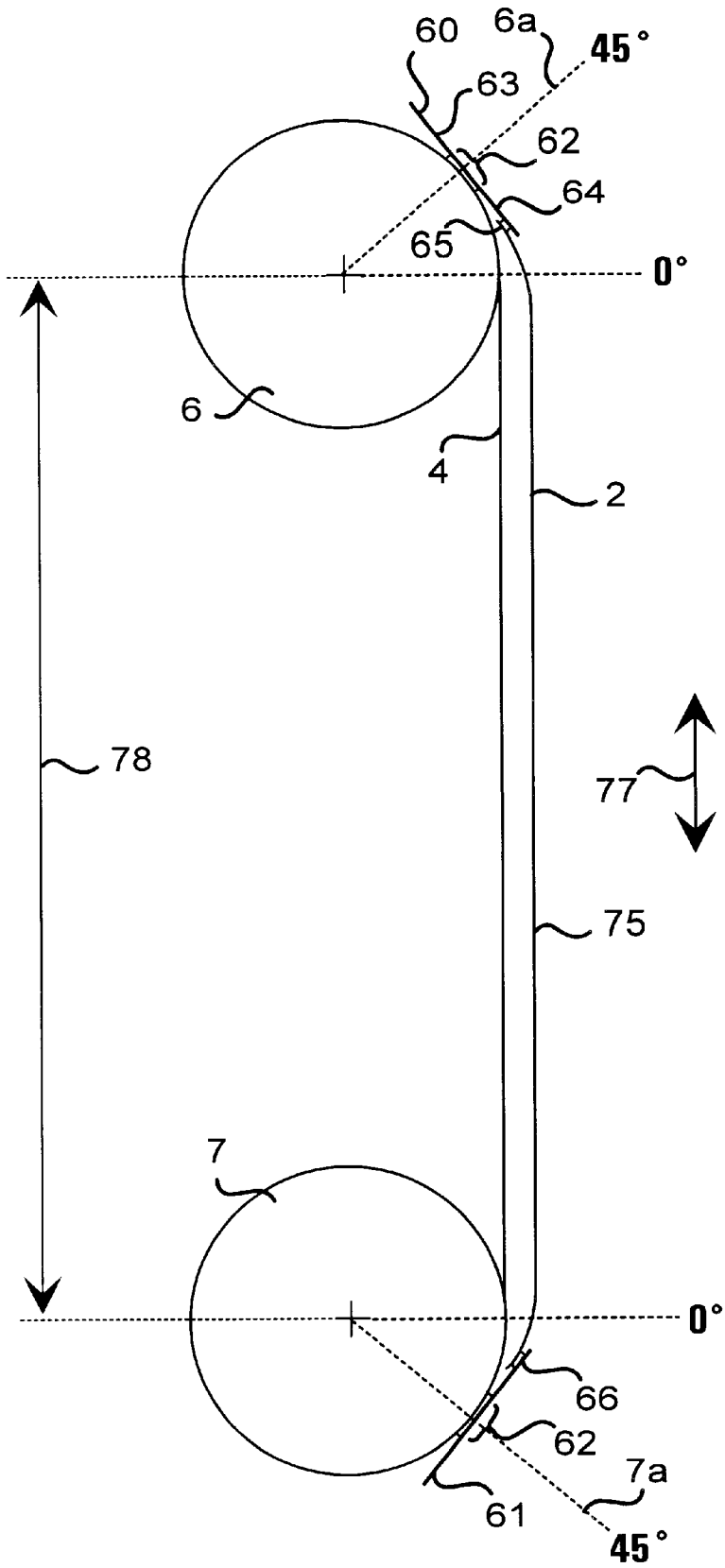
FIG. 10 is a cross-sectional diagrammatic side view of a chart wound upon two rollers showing the proper dimensions for implementing the banner flattening mechanism of the invention using resiliently flexible strips.

FIG. 10 shows a cross-sectional diagram of a banner 2 in its display position mounted between a pair of resiliently flexible strips 60,61 which are attached along a medial portion 62 to the carrier web 4 which is wound upon a pair of rollers 6,7. The width of the strips in the travel direction 77 and their resiliency are adjusted so that when a banner is displayed between the rollers, the medial portion 62 of each strip is wound onto the curved surface of the rollers leaving marginal portions 63,64 contiguous to the banners free to assume, due to their resiliency, a more planar tangential position in relation to the rollers. The spring-like effect of the strips propel a medial section 75 of the banner 2 outwards from the carrier 4, thereby taking up the slack generated through unwinding sufficient to eliminate wrinkles and small distortions.

As in the prior embodiment, in order to properly propel the banner's medial section, the location of the strips on the carrier web must be calculated after taking into account the physical properties of the display, rollers, and banners. In general, for most common applications it has been found that the position on the surface of the roller is preferably at least about 45 degrees 6*a*,7*a*.

The width of each strip depends on the resiliency of each strip and the physical properties of the display, rollers and scroll. However, for most common applications, it has been found that the width of each strip will extend over an are of approximately 20 to 90 degrees, and most preferably about 45 degrees when the entire chart is wound onto one roller.

The advantage of this embodiment is that the end sections of the banner need not be as resilient as in the prior embodiment, since the propelling function has been taken over by the resiliency of the strip.

FIG. 11 illustrates some of the preferred means for releasably bonding banners to the resiliently flexible strips, each of which offers certain advantages and disadvantages. FIG. 11*a* shows a portion of the carrier web 4 onto which a flexible strip 60 has been attached. One end of a banner 2 is releasably attached to the strip by means of an adhesive layer 100 of material such as non-permanent glue, spirit gum or double-sided adhesive tape. Although the banner could be attached to an outer surface 101 of the strip, it is preferred that the banner attach to the inner surface 102 of the strip facing the carrier web 4 to protect the banner edge 103 and the adhesive layer. After repeated use the adhesive tends to lose its stickiness, requiring replacement. Therefore, individual banners may be provided with an adhesive layer already positioned at each end, protected by a removable wax paper cover, insuring fresh adhesive with each new banner.

Figure 11A:
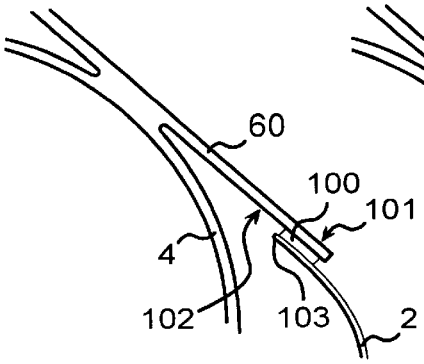
FIG. 11, *a–f* shows six cross-sectional diagrammatic views of alternate embodiments of the means for bonding a banner to a resilient strip according to the invention.
Figure 11B:
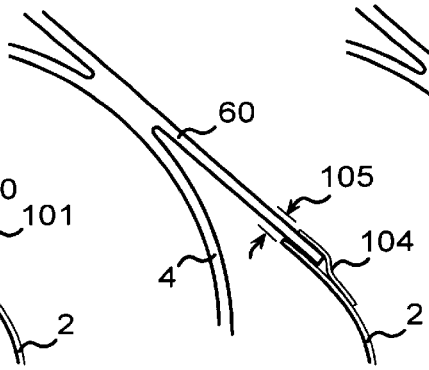
Figure 11C:
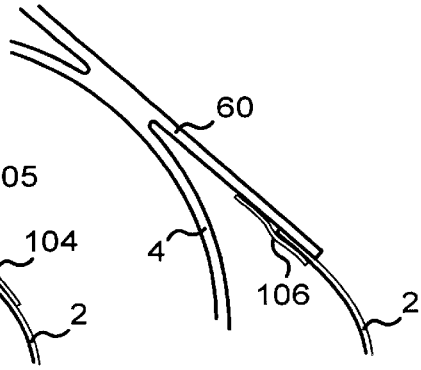

FIG. 11*b* and 11*c* show that a piece of single-sided adhesive tape may be used to join an end of the banner 2 to the flexible strip 60. In 11*b* the adhesive tape 104 is placed on the outer surfaces of the banner and strip. The advantages of this scheme are that the banner/strip interface has a very thin cross-sectional thickness 105, and tape is inexpensive. However, the tape layer is visible during scroll winding. In 11*c* the tape 106 adheres to the inner surfaces of the banner and strip, and is therefore hidden from view. However, properly placing the tape during installation requires more skill. If stronger attachment is required, two pieces of tape may be used, one on the outer surface as shown in 11*b* and one on the inner surface as in 11*c*.

Figure 11D:
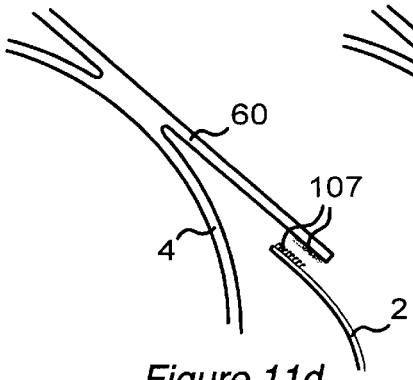

In FIG. 11*d*, hook-and-loop fabric style connectors such as VELCRO Brand fasteners 107 are used to releasably connect an end of the banner 2 to an end of the flexible strip 60. However, the cross-sectional thickness of the connection is greater.

Figure 11E:
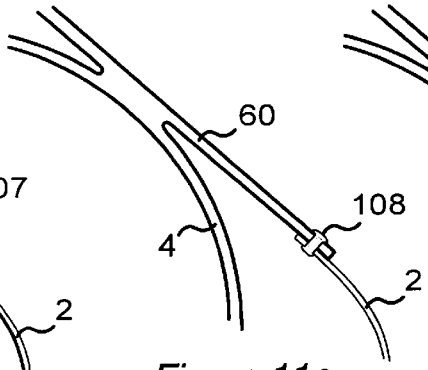

In FIG. 11*e* pop-through snap pins 108 may be used to join the banner 2 to the strip 60 as in the prior embodiment as described in reference to FIG. 8*f*.

Figure 11F:
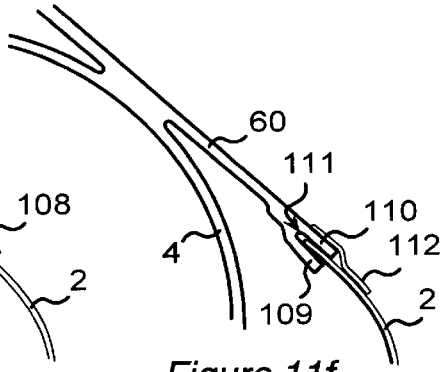

FIG. 11*f* shows two extensions 109,110 extending along the edge of the resiliently flexible strip 60 to form a slot 111 into which the edge of the banner 2 is inserted, providing more secure, immobile attachment. The extensions may be joined at their lateral edges so as to form a pocket to further discourage lateral migration of the banner. In this arrangement, any of the above described attachment schemes may be used. A piece of single-sided adhesive tape 112 is shown. This arrangement may be slightly more expensive to manufacture and exhibits a thicker cross-section.

Figure 12A:
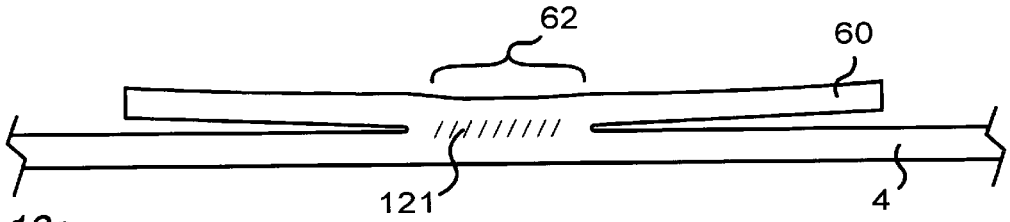
FIG. 12, *a–f* shows six cross-sectional diagrammatic views of alternate embodiments of the banner-connecting, resiliently flexible strip feature of the invention.
Figure 12B:
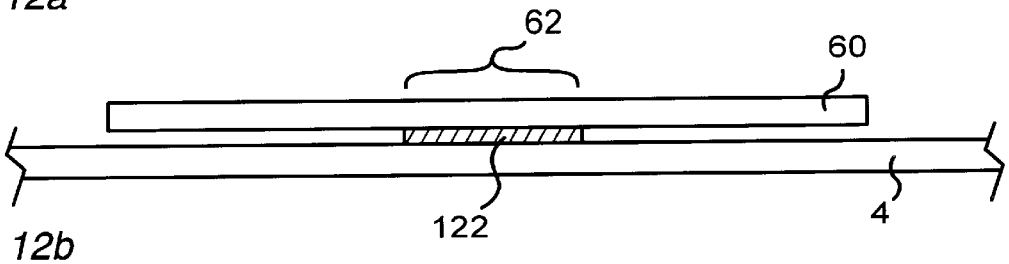
Figure 12C:
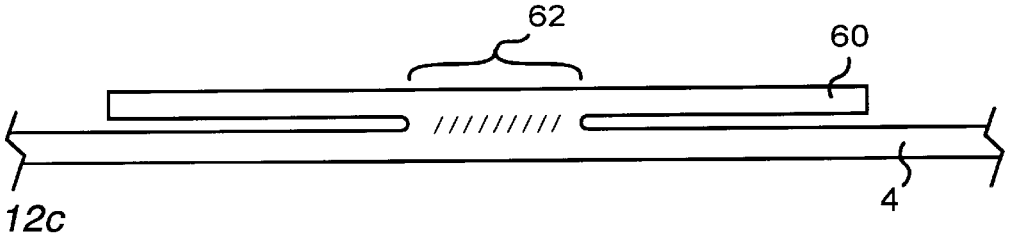
Figure 12D:
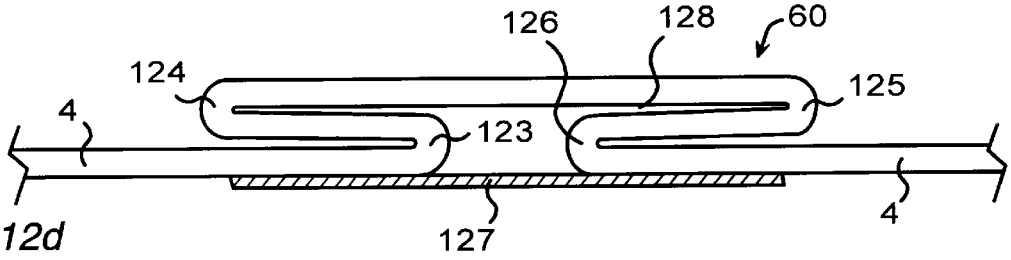
Figure 12E:
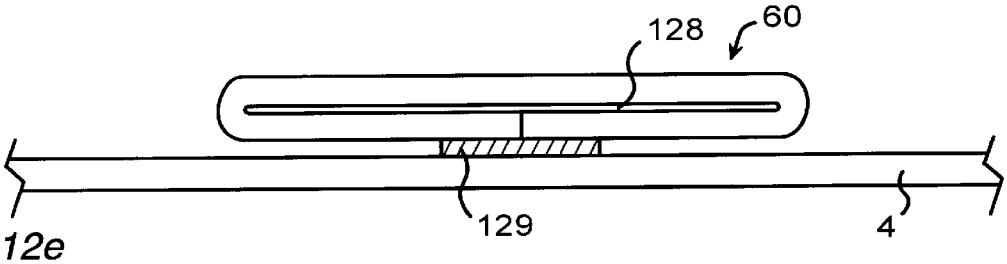
Figure 12F:
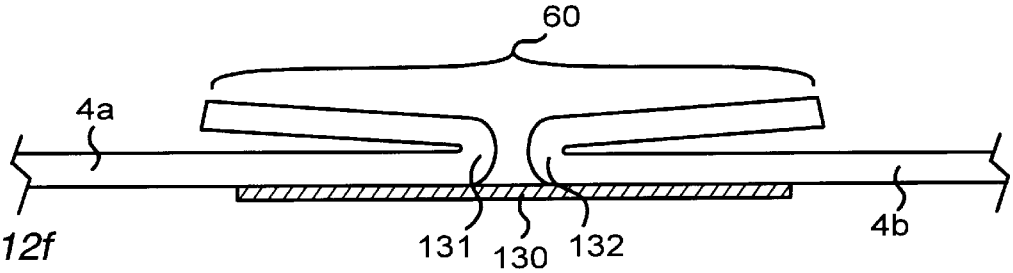

FIGS. 12*a*–12*f* show alternate ways of forming or attaching the flexible strips to the carrier web. In FIG. 12*a*, a medial portion 62 of the strip 60 has been heat welded 121 to the web 4. In FIG. 12*b*, a layer of adhesive 122 such as glue or double-sided adhesive tape attaches a medial portion 62 of a strip 60 to the web 4. In FIG. 12*c*, solvent was used to bond a medial portion 62 of the strip 60 to the web 4. In FIG. 12*d*, the transparent carrier web 4 is multiply folded 123,124,125,126 to form a pocket 128 into which a border message card may be inserted. A piece of single-sided adhesive tape 127 prevents the web from unfolding. Similarly, in FIG. 12*e*, a strip 60 is formed by a ring of transparent web material. Again, a pocket 128 is formed into which a message card may be inserted. The strip is attached to the web 4 by a layer of adhesive such as double-sided tape 129. Finally, FIG. 12*f* shows the carrier web formed by separate pieces 4*a*,4*b* bonded by a layer of single-sided adhesive tape 130. Each piece has an outward fold 131,132 which forms the resiliently flexible strip 60.

As in the prior embodiment, proper mounting of the banners is achieved automatically when installing or loading a banner into a particular frame. First, the top end of a banner is attached to a trailing flap of the upper resiliently flexible strip. With its bottom end free, the banner is then wound smoothly onto the top roller. Finally, the banner's bottom end is attached to the leading flap of the lower strip.

The preferred method of running the motors is now described. In general, the motors are inexpensive D.C. motors of the type commonly found toys which turn in a direction and speed corresponding to the polarity and duty cycle of their drive voltages. However, depending on overall chart size, more or less powerful motors may be required.

As disclosed in Simson et al., U.S. Pat. No. 5,410,330, incorporated herein by reference, it is beneficial for the unwinding motor to provide a variable drag, as transmitted through the scroll, on the winding motor. This causes the scroll to remain taut and to traverse smoothly between the rollers. In addition, the unwinding motor provides energy efficient assistance in moving the chart. In the preferred embodiment of the invention, drag is accomplished by powering the unwinding motor using a pulse width modulated (PWM) drive voltage waveform in which the duty cycle duration is less than the duty cycle duration of the drive voltage waveform powering the pick-up motor.

A PWM drive voltage waveform may also be used to prevent sagging or drooping of the chart while a banner is being displayed. This can be a problem with heavier banners and fabric or paper banners which have become saturated with water. During non-winding times, one or both of the motors are given a PWM driving waveform having a winding polarity to stretch the chart taut. In this embodiment, of course, the winding polarity of one motor is opposite to the winding polarity of the other motor.

Figure 13:
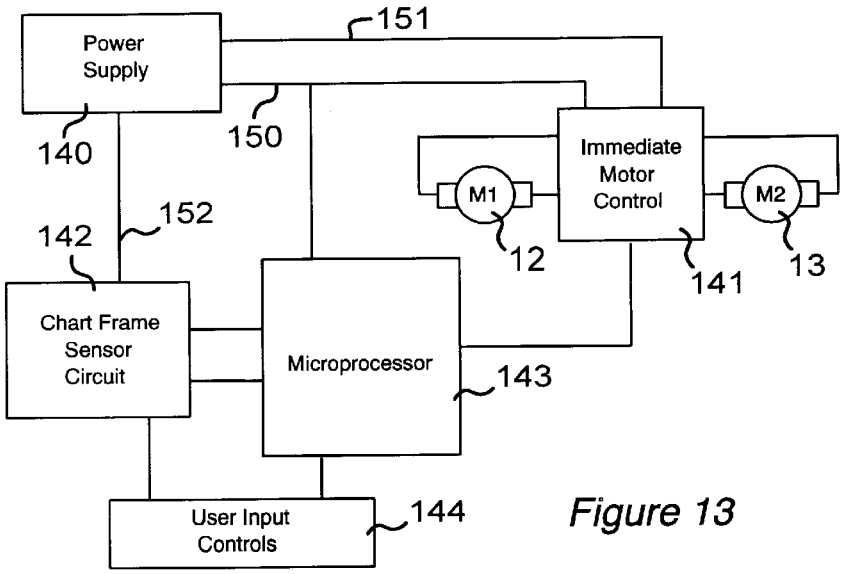
FIG. 13 is a block diagram of the preferred roller control circuitry of the invention.

With reference to FIGS. 13, the preferred roller command and control mechanisms and circuitry will now be described. Although circuitry described in Simson et al., U.S. Pat. No. 5,410,330 may be used, the preferred approach involves the use of a programmed microprocessor.

In general, FIG. 13 shows a functional block diagram of the major modules. The circuitry comprises a power supply circuit 140, motors 12,13, an immediate motor control circuit 141, a photo-electric chart frame sensor circuit 142, a microprocessor 143, and a user/operator input circuit 144.

The microprocessor 143 interprets signals from the chart sensor circuit and user input circuitry using its internal programming to generate commands, including the PWM motor control signals for directing the immediate motor control circuitry 141 to move the motors. The microprocessor can be implemented using PIC or other commonly available computer. Here, the computer is a small 4 Kbyte programmable device having a 4 MHz exterior crystal oscillator and has interior bypass capacitors. It is programmed via a developmental system linked to a standard personal computer. Therefore, it is reprogrammable to fit the needs of a particular application with respect to display time parameters including variable time display, variable time of day or week display, or even units that can respond to a pager signal. The program inside the microprocessor contains all the control logic, command structure and PWM algorithms.

The immediate motor control circuitry 141 simply applies the proper drive voltage waveforms to the motors 12,13 according to the command signals arriving from the microprocessor 143. The circuitry also provides for dynamic braking of the motors to lessen motion due to inertia. The preferred approach involves implementing the immediate motor control circuitry with a solid state motor control chip, such as an Allegro motor control chip, for each motor and overload protection. These chips can receive and implement PWM motor control signals and other commands directly from the microprocessor. Solid state control is preferred due to its smaller size and the fact that relays generally make and break circuits under load, thereby burning contacts and lessening reliability with time.

User/operator input controls 144 are in the form of manual switches and dials or even a pager receiver. These devices signal the chart frame sensor circuit and the microprocessor, which still handles direct, powered control of the motors. Included among the controls is an auto/manual switch which allows the operator to control the apparatus from other controls on the front control panel (34 in FIG. 4) in order to load/change banners or just set the machine in a static mode, if desired.

An up/down, three position rocker switch allows for manual powered winding of the chart in either direction.

A multi-position is provided for the variable selection of banner display times. A Binary-Coded Decimal (BCD) or Octal rotary switch which directly interfaces with the microprocessor is preferred. Each position corresponds to a different display time ranging in the basic configuration from two seconds to one hour. The selectable display times are determined by algorithms in the computer program, and thus can also be altered by reprogramming.

One or more LED indicators may be provided to reflect the status of the switches and power availability.

The chart frame sensor circuit 142 comprises an electronic eye for sensing the passage of indicia located along the edge of the scrolling chart. The electronic eye contains an infra-red (IR) photo emitter and IR photo transistor arranged in a pulsed AC coupled detector scheme to reduce susceptibility to false signals. The microprocessor controls the eye repetition and the filtering and detection algorithms. Preferably, the emitter is pulsed from 2 to 20 KHz allowing for a very closely coupled scheme, capable of working in direct sunlight, near flash bulbs, or other high energy IR light sources.

Sensitivity of the eye circuit is controlled via a potentiometer on the user/operator input panel. This manually adjusts the current sent through the emitter and thus the strength of the output signal.

One advantage of this approach is that either a transmissive or reflective eye may be used in the sensor circuit depending on the application. Neither the circuitry nor the programming needs to be changed to accommodate either reflective or transmissive eye devices.

The power supply circuitry 140 provides a first operational voltage 150 used to power the integrated circuit based microprocessor 143 and immediate motor control 141. A second line 151 supplies the motor operational voltage to the motors through the immediate motor control circuitry. A third line 152 provides the proper voltage for the operation of the chart frame optical sensor circuit.

In the preferred embodiment, the power supply comprises the plug-in transformer which provides 12 volts A.C. to a rectifier circuit which converts it to the motor operational voltage of 17.5 volts D.C. The power supply further comprises 12 volt and 5 volt regulators, such as 7812 and 7805 TO-220 configuration devices, which are linear integrated circuits containing built-in current protection circuitry. These regulators are configured into a filtered, anti-droop circuit for providing stable power to the chart sensor circuit, and the microprocessor and immediate motor control chips.

An alternate embodiments of the apparatus can be powered by an internal set of batteries. In order to reduce the power requirement, the back-lights can be eliminated. Instead, the back of the enclosure is left open or made of transparent or translucent material. The electrical control can be limited to a double-pole/double-throw rocker switch, thus eliminating the timing and mark-detecting circuitry.

The preferred chart frame detection scheme will be described in detail. In general, indicia or marks are placed along an edge of the carrier web to indicate the position of the frame within the viewing window and to inform the display controller whether to skip a frame or to wind in the opposite direction. One embodiment, as shown in FIGS. 14–17, provides a user manipulable indicator 160 so that the display of individual frames can be controlled.

Figure 14:
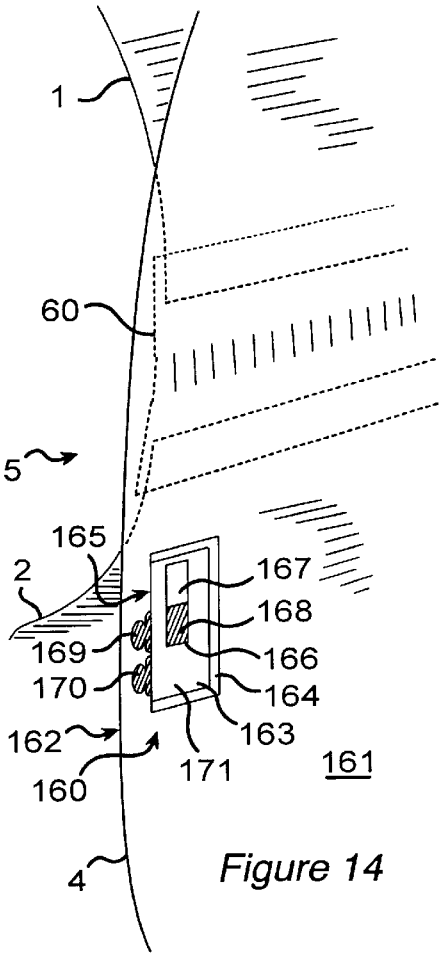
FIG. 14 is a partial perspective view of a scrolling chart having a chart frame indicator according to the invention.

FIG. 14 shows a rear view of an edge section of the scrolling chart 5. Shown is the rear surface 161 of the carrier web 4 at a point between chart frames where two banners 1,2 are attached to a resilient strip 60. A user manipulable chart frame indicator 160 is positioned on a portion of the web 4 proximate to the edge 162 so that it may be scanned by the optical sensor described earlier.

The indicator comprises a small generally rectangular sheet 163 of pliable material such as mylar. The sheet is attached to the web along three of its edges 164, thereby forming a pocket 165 between the web and sheet. An oblong window 166 is cut through the sheet exposing first and second adjacent indicator positions 167,168 or sub-windows.

Sheet-like indicator tabs 169,170 may be inserted into the pocket at points corresponding to the first and second indicator positions. A third position 171 can be provided to store unused tabs. In this embodiment, a reflective sensor is used. Therefore, the tabs have a reflective outer surface, whereas the rear surface of the carrier web and the outer surface of the sheet are relatively non-reflective. The insertion of tabs in one or both of the indictor positions informs the display control how to display this particular frame position.

Therefore, the placement of a tab into a sub-window alters an optical characteristic of the sub-window which can be read by the optical sensor. In this case the altered characteristic is reflectivity. In a transmissive scheme, the altered characteristic would be the transparency of the sub-window.

Figure 15:
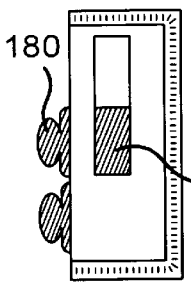
FIG. 15 is a diagrammatic front view of the chart frame indicator arranged in the "display banner then continue" configuration.

FIG. 15 shows a reflective tab 180 inserted in the first indicator position 168. This informs the display control that the current frame is in position to be displayed, and that winding is to continue in the same direction after display is complete.

Figure 16:
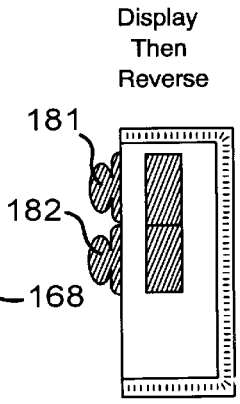
FIG. 16 is a diagrammatic front view of the chart frame indicator arranged in the "display banner then reverse" configuration.

FIG. 16 shows that two reflective tabs 181,182 are inserted into both the first and second indicator positions. This informs the display control that the current frame is in position to be displayed, and that the winding direction should be reversed after display is complete. This typically occurs at the frames at each end of the scrolling chart.

Figure 17:
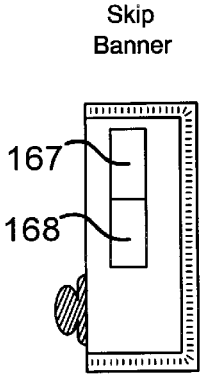
FIG. 17 is a diagrammatic front view of the chart frame indicator arranged in the "skip banner" configuration.

FIG. 17 shows that no reflective tabs have been inserted into either the first or second indicator positions 167,168. This informs the display control that the current frame is to be skipped, and that winding is to continue in the same direction.

This system of indicators can be implemented in other ways such as using apertures and transmissive sensors. In this way, pieces of duct-tape may simply be used to block the aperture. If the web is highly reflective the tabs can be non-reflective.

Alternatively, the indicator may be modified to contain even more information providing individual frame control, such as custom viewing times. For example, the optical sensor can be a bar code reader. A bar code may be printed on an adhesive tape label which is placed when the banner is installed. If the frame is to be skipped, the label is removed.

The structural, mechanical and electrical simplicity of the preferred apparatus allows for the manufacture of reliable, yet inexpensive displays ranging in heights from approximately 20 cm (8 inches) to 230 cm (90 inches) suitable for displaying a variety of charts made of paper, fabric, mylar or other synthetic materials.

A scroll of fifty 20 cm×25 cm (8×10 inches) frames on 25 micron (1 mil) thick printable plastic material results in a 3 cm (1.2 inch) diameter roll.

Many other features disclosed in Simson, U.S. Pat. No. 5,493,802, such as grounded, electrically conductive chart guides and anti-static strips mounted to the chart, may be incorporated in the current invention as needed.

While the preferred embodiment describes horizontal rollers and a chart scrolling vertically, the invention applies equally to other orientations.

While the preferred embodiment does not require to use of guide rollers anterior to the chart spooling rollers, they may be used without departing from the invention. However, care must be taken to properly locate, size and space apart the rollers so that the attachment points or strip medians are properly positioned on the guide rollers during display.

While the preferred embodiment details an apparatus for displaying window-size banners which a single person would have no trouble manipulating, the invention applies equally to larger billboard-sized banners or smaller toy-sized banners. Those skilled in the art could easily modify the components to accommodate banners and charts of such dimensions.

While the preferred embodiments of the invention have been described, modifications can be made and other embodiments may be devised without departing from the spirit of the invention and the scope of the appended claims.

What is claimed is:

1. In a banner display device where a plurality of image carrying banners made from flexible sheet material are mounted substantially end-to-end to form a scroll, and said scroll is wound upon a pair of parallely mounted, symmetrical rollers having axes sufficiently spaced apart to sequentially display each of said banners therebetween when said scroll is alternately wound and unwound between said rollers, an improvement for automatically regulating the tautness of each banner as it is displayed between said rollers, said improvement comprising:

each banner having a displayed medial section;

means carried with said scroll for stretching taut said medial section;

wherein said scroll comprises:

a continuous banner-carrying web having a plurality banner-holding frames; and means for securing said banners to said web;

wherein said means for securing said banners to said web comprise a plurality of spaced apart banner attachment points formed on said web; and wherein said means for stretching taut comprise means for allowing a lower one of leading and trailing sections to extend through the force of gravity radially away from said second roller.

2. The improvement of claim 1, wherein said means for securing further comprise hook and loop fastening means associated with said banner attachment points.

3. The apparatus of claim 1, which further comprises motor means for winding said rollers in concert and electrical circuit means for powering said motor means using a pulse width modulated motor drive signal.

4. A device for sequentially displaying each of a plurality of image carrying banners, said device comprises:

a flexible carrier web wound upon a pair of parallely spaced apart rollers;

means for securing each of said banners to said web;

each banner having a medial section;

means carried upon said scroll for stretching taut said medial section during display; and wherein said means for stretching taut comprise means for allowing a lower section of each of said banners to extend through the force of gravity radially away from a lower one of said rollers.

5. The device of claim 4, wherein said scroll comprises:

a continuous banner-carrying web having a plurality banner-holding frames; and means for securing said banners to said web.

6. The device of claim 5, wherein said means for securing said banners to said web comprise a plurality of spaced apart banner attachment points formed on said web.

7. The device of claim 4, wherein said means for stretching further comprise:

each banner having:

a leading end attached to a first of said attachment points;

a leading section proximal to said leading end;

a trailing end attached to a second of said attachment points; and a trailing section proximal to said trailing end;

wherein said first attachment point is wound onto a curved portion of a first roller and said second attachment point is wound onto a curved portion of a second roller.

8. The device of claim 4, which further comprises motor means for winding said rollers in concert and electrical circuit means for powering said motor means using a pulse width modulated motor drive signal.

* * * * *